US006953321B2

(12) United States Patent
Roudnev et al.

(10) Patent No.: US 6,953,321 B2
(45) Date of Patent: Oct. 11, 2005

(54) CENTRIFUGAL PUMP WITH CONFIGURED VOLUTE

(75) Inventors: Aleksander S. Roudnev, De Forest, WI (US); Ronald J. Bourgeois, Sun Prairie, WI (US); Ricardo Augusto Abarca Melo, Santiago (CL)

(73) Assignee: Weir Slurry Group, Inc., Madison, WI (US)

( * ) Notice: Subject to any disclaimer, the term of this patent is extended or adjusted under 35 U.S.C. 154(b) by 50 days.

(21) Appl. No.: 10/335,584

(22) Filed: Dec. 31, 2002

(65) Prior Publication Data

US 2004/0126228 A1 Jul. 1, 2004

(51) Int. Cl.[7] ..... F04D 7/04
(52) U.S. Cl. ..... 415/197; 415/206
(58) Field of Search ..... 415/196, 197, 415/204, 206, 207, 212.1

(56) References Cited

U.S. PATENT DOCUMENTS

| | | | | |
|---|---|---|---|---|
| 132,829 A | | 11/1872 | Harris | |
| 834,848 A | | 10/1906 | Price | |
| 1,107,591 A | | 8/1914 | DeHuff | |
| RE14,988 E | * | 11/1920 | Parsons | 415/197 |
| 1,585,669 A | | 5/1926 | Hansen | |

(Continued)

FOREIGN PATENT DOCUMENTS

| | | | | |
|---|---|---|---|---|
| DE | 2220050 | | 11/1973 | |
| DE | 2235193 | | 2/1974 | |
| FR | 972528 | | 8/1950 | |
| GB | 2 062 102 A | * | 5/1981 | F04D/29/42 |
| RU | 1247582 C | | 5/1983 | |
| SU | 681-221 | | 3/1978 | |
| SU | 798-359 | | 12/1978 | |
| SU | 781-395 | | 4/1979 | |
| SU | 676-760 | | 7/1979 | |
| SU | 885-615 | | 11/1981 | |
| WO | WO 96/27085 | | 9/1996 | |

OTHER PUBLICATIONS

Addison, H., Centrifugal and Other Rotodynamic Pumps, 3rd Ed. London: Chapman & Hall (1966), pp. 47–53, 101–102.

Cheremisinoff, N., Fluid Flow, Pumps, Pipes and Channels, Ann Arbor, Michigan: Ann Arbor Science Publishers, Inc. (1981) pp. 269, 294, 296.

Lazarkiewicz, S., et al., Impeller Pumps, Warsaw: Pergamon Press (1965) pp. 269–276, 280–281.

Product Brochure Form 3759, Warman International, Inc. "Heavy–Duty Slurry Pumps", 12 pgs.

Schlichting, H., Boundary Layer Theory, New York: McGraw Hill Book Co. (1979), pp. 525–526, 528–536.

Pumping Manual, 7th Ed., Gulf Publishing Co., Houston, Texas: Gulf Publishing Co. (1984), p 389.

*Primary Examiner*—Edward K. Look
*Assistant Examiner*—Richard A. Edgar
(74) *Attorney, Agent, or Firm*—Morriss O'Bryant Compagni

(57) ABSTRACT

A selectively configured volute for incorporation into a centrifugal pump of the volute type is disclosed for use in processing heavy duty slurries that are characterized by containing particularly large and/or abrasive particulates that are known to degrade the pump casing or pump casing liner. The configured volute of the present invention is particularly suitable for use in connection with the use of an impeller having expelling vanes that aggressively pump out slurry from the seal face of the pump. The configured volute of the present invention provides resistance to wear when processing heavy duty slurries and provides stable flow performance and improved pump performance.

19 Claims, 7 Drawing Sheets

U.S. PATENT DOCUMENTS

| | | | | |
|---|---|---|---|---|
| 2,163,464 | A | | 6/1939 | Llewellyn |
| 2,190,245 | A | | 2/1940 | Sartell |
| 2,312,422 | A | | 3/1943 | Kumlin et al. |
| 2,353,871 | A | | 7/1944 | Bowen |
| 2,471,174 | A | | 5/1949 | Trumpler |
| 2,515,398 | A | | 7/1950 | Derocher |
| 2,635,548 | A | | 4/1953 | Brawley |
| 2,851,289 | A | | 9/1958 | Pedersen |
| 2,992,617 | A | | 7/1961 | Kroeger |
| 2,999,628 | A | | 9/1961 | Crombie |
| 3,018,736 | A | | 1/1962 | Clay |
| 3,115,099 | A | | 12/1963 | Clay |
| 3,265,002 | A | | 8/1966 | Warman |
| 3,306,216 | A | | 2/1967 | Warman |
| 3,316,848 | A | | 5/1967 | Egger |
| 3,318,254 | A | | 5/1967 | Palmberg et al. |
| 3,460,748 | A | | 8/1969 | Erwin |
| 3,628,881 | A | | 12/1971 | Herrmann |
| 3,656,861 | A | | 4/1972 | Zagar |
| 3,689,931 | A | | 9/1972 | Fortis |
| 3,732,028 | A | | 5/1973 | Heynemanns et al. |
| 3,743,437 | A | | 7/1973 | Warren |
| 3,758,227 | A | | 9/1973 | Pollak et al. |
| 3,824,029 | A | | 7/1974 | Fabri et al. |
| 4,213,742 | A | | 7/1980 | Henshaw |
| 4,234,291 | A | | 11/1980 | Hurst et al. |
| 4,264,273 | A | | 4/1981 | Grzina |
| 4,381,171 | A | | 4/1983 | Chapple |
| 4,917,571 | A | | 4/1990 | Hyll et al. |
| 5,040,947 | A | * | 8/1991 | Kajiwara et al. ..... 415/206 |
| 5,127,800 | A | | 7/1992 | Hyll et al. |
| 5,605,442 | A | * | 2/1997 | Wilson et al. ..... 415/206 |

* cited by examiner

CENTRIFUGAL PUMP WITH CONFIGURED VOLUTE

BACKGROUND OF THE INVENTION

1. Field of the Invention

This invention relates to centrifugal pumps used in industrial applications to process slurries, and specifically relates to centrifugal pumps having a volute especially configured to process highly abrasive slurries.

2. Description of Related Art

Centrifugal pumps of the volute type are well-known in the art and have a pump casing that is generally circular or toroidal in shape. The outer peripheral region of the circular pump casing defines the volute region of the pump. The volute region surrounds an impeller positioned within the pump casing and is positioned to receive fluids which are processed by the impeller. The inner volute region of the pump casing thus serves as a collector of fluid being forced outwardly by the impeller under centrifugal forces.

Typically, the volute region of the pump casing changes in volume as it extends about the circumference of the pump casing. That is, the axial cross section of the volute region of the pump casing taken at any point around the circumference of the pump casing reveals that the volute has a volume that changes. The varying volume of the volute about the circumference of the pump casing effects the flow dynamics of the pump as the fluid moves from the cutwater region of the pump casing to the discharge nozzle.

Additionally, the type of fluids being processed by the pump further dictate the selected volume or shape of the volute. It is well known that regions of instability occur in centrifugal pumps of the volute type. Such flow instabilities can cause fluctuations in fluid pressure and can adversely affect pump efficiencies. Instabilities in the flow are also known to be caused by the type of fluids being pumped (i.e., clear water versus slurries).

U.S. Pat. No. 5,127,800 to Hyll, et al., describes how volute pump design differs between a pump used to process clear water (i.e., fluid that is low in, or essentially devoid of, solids content) and a pump used to process slurries. Namely, the impeller of a clear water pump has shrouds the thickness of which is typically comparatively smaller because the fluid, being devoid of particulates, does not cause wear on the impeller. However, the shrouds of the impeller in a slurry pump are described as being thicker to compensate for degradation of the impeller due the solids content of the fluid. The increased thickness of the impeller shrouds results in the development of turbulent flow patterns as the fluid exits the impeller and enters the volute region of the pump. The patent to Hyll, et al., therefore discloses a volute that is particularly shaped to compensate for the turbulent flow patterns that result in slurry pumps.

The volute design that is disclosed in the '800 patent to Hyll et al., is selectively configured with arcuate contours the shape or radius of curvature of which varies about the circumference of the pump casing. Specifically, the volute contour at the cutwater region of the pump, when viewed in axial cross section, comprises a single symmetrical curvature. The contour of the volute gradually changes to comprise a trio of connected concave areas the radii of curvature of which change along the circumference of the pump casing in the direction of the discharge nozzle. The cross section configuration of the volute at any point along the circumference of the pump casing in the '800 patent is essentially symmetrical about a plane radially bisecting the volute region.

The volute design disclosed in the '800 patent to Hyll, et al., is particularly suited for processing slurries of lower solids content at high flow rates. It has been found, however, that while the design of that volute provides stable performance curves, the design is prone to wear by abrasive solid particles in the pumped slurry. This is particularly true in slurry applications that are considered "heavy duty" by virtue of the size and coarseness of the solids contained in the slurry, such as crushed ore slurries.

When pumping heavy duty slurries, the impeller of the pump must be configured with aggressive expelling vanes on the front shroud of the impeller (i.e., the shroud adjacent the pump inlet) to protect the seal face from abrasive solids. More aggressive expelling vanes operate to create extensive outward oriented vortices behind the expelling vanes which keep abrasive solid particles in suspension in the volute of the pump and prevent the particles from infiltrating the seal area. The vortices created by aggressive expelling vanes transfer additional velocity to the abrasive solid particles, however, which wears out the convex portions of the contoured volute design disclosed in the '800 patent and degrades the wall surface of the volute.

Thus, it would be beneficial in the art to provide a configured volute for a centrifugal pump that is designed to address the volute degradation encountered in the processing of slurries, particularly those containing coarse and/or more abrasive solids particulates, while still providing stable performance curves.

BRIEF SUMMARY OF THE INVENTION

In accordance with the present invention, the volute region of a centrifugal pump is configured with an interior surface contoured to process fluid slurries, particularly those containing coarse and abrasive solids, and to withstand the degradation caused by such slurries thereby providing stable performance curves for the pump. The volute configuration of the present invention can be incorporated into the interior surface of a pump casing or can be incorporated as the interior configuration of a pump liner sized to fit within a pump casing.

A centrifugal pump incorporating the volute configuration of the present invention generally comprises a circular pump casing having an impeller positioned within the pump casing. The impeller is connected to an axially-oriented drive shaft which rotates the impeller within the pump casing. The impeller further comprises at least one impeller blade positioned between spaced apart shrouds, and has at least one discharge opening positioned at the periphery of the impeller for directing fluid toward the volute of the pump casing. The impeller is also structured with at least one expelling vane extending axially from the suction side shroud of the impeller.

The pump casing is typically comprised of a pair of wall portions which, when fitted together, enclose the impeller. One side of the pump casing, hereinafter referred to as the drive side casing, has an opening through which the drive shaft extends to connect to the impeller. The opposing side of the pump casing, hereinafter referred to as the suction side casing, has an opening which defines the inlet for fluid flow into the impeller. The interior surface of the outer peripheral wall of the conjoined drive side and suction side pump casings defines the volute. In one embodiment of the invention, the pump casing may be configured in accordance with the invention. In an alternative embodiment, the volute configuration of the invention may be incorporated into a liner which is positioned within the pump casing.

The volute configuration of the present invention extends along a substantial length of the circumference of the pump casing or pump liner between a cutwater region and a throat region that leads into a discharge nozzle formed in the pump casing. The volute is configured with a contoured inner surface the shape of which is selected to optimize fluid flow from the impeller into and through the volute of the pump, thereby providing stable performance curves.

As is known in the art of pumping slurries, the impeller is selected to have a thicker shroud (as compared with the impeller shrouds of a clear water pump) because the impeller is desirably made to withstand the abrasive effects of the slurry. Consequently, the axial width of the impeller opening may be smaller than the axial width of the volute. The disparity between those respective widths can result in flow instabilities. Thus, the volute of the present invention is contoured to reduce those flow instabilities.

Additionally, when pumping heavy duty slurries, the impeller must be configured with aggressive expelling vanes, located on the suction side shroud of the impeller, to protect the seal face from abrasive solids. More aggressive expelling vanes operate to create extensive outward oriented vortices behind the expelling vanes which keep abrasive solid particles in suspension in the volute region and prevent the particles from infiltrating the seal area. As used herein, aggressive expelling vanes are those which produce a differential head which is generally not less than about forty percent of the total pump head produced by the impeller vanes. The vortices created by aggressive expelling vanes transfer additional velocity to the abrasive solid particles which wears out the convex portions of known volute designs. Thus, the volute configuration of the present invention is selected to reduce the degradation caused by those vortices and to prevent degradation of the inner surface of the volute caused by more aggressive slurries.

To achieve the foregoing stated objectives, the volute of the present invention comprises a configured inner surface which is asymmetrical about a radial plane that bisects the pump casing. The volute comprises a first wall that is curved from a point near the impeller shroud bearing the expelling vanes to the outer periphery of the volute and a second wall that is configured with two concave regions having disparate radii of curvature. The first wall contour defines a collector zone for receiving fluid from the impeller. The concave regions of the second wall respectively define a contiguous portion of the collector zone and a circulation zone for channeling the flow exiting the impeller opening into the collector zone to thereby reduce turbulence in the fluid flow entering the volute.

The configuration of the axial cross section of the volute changes from the cutwater of the pump to the throat region near the discharge nozzle of the pump to optimize the flow of slurry entering into and traveling through the volute region to the discharge nozzle. The contoured surface of the volute extends to the beginning of the discharge nozzle of the pump where the inner surface of the discharge nozzle gradually becomes circular in axial cross section.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

The volute configuration of the present invention is part of a centrifugal pump of the volute type, a pump structure which is well-known in the art. Accordingly, reference is made to U.S. Pat. No. 5,127,800, the contents of which are incorporated herein by reference, as illustrating the essential elements of a centrifugal pump of the volute type. In particular, the centrifugal pump comprises a pump casing which is typically formed in two clamshell-like halves. Each pump casing half is generally circular and has a tangentially extending portion defining a discharge nozzle portion. The outer peripheral portion of each casing half provides a wall portion. When the two halves of the pump casing are joined together and are sealed about their circumference and along the discharge nozzle portion, the peripheral wall portions join to provide a volute region of the pump. An impeller is positioned within the pump casing and is driven by an axially-oriented drive shaft connected to the impeller. The impeller has at least one impeller opening that is oriented toward the volute region of the pump.

Figure 1:
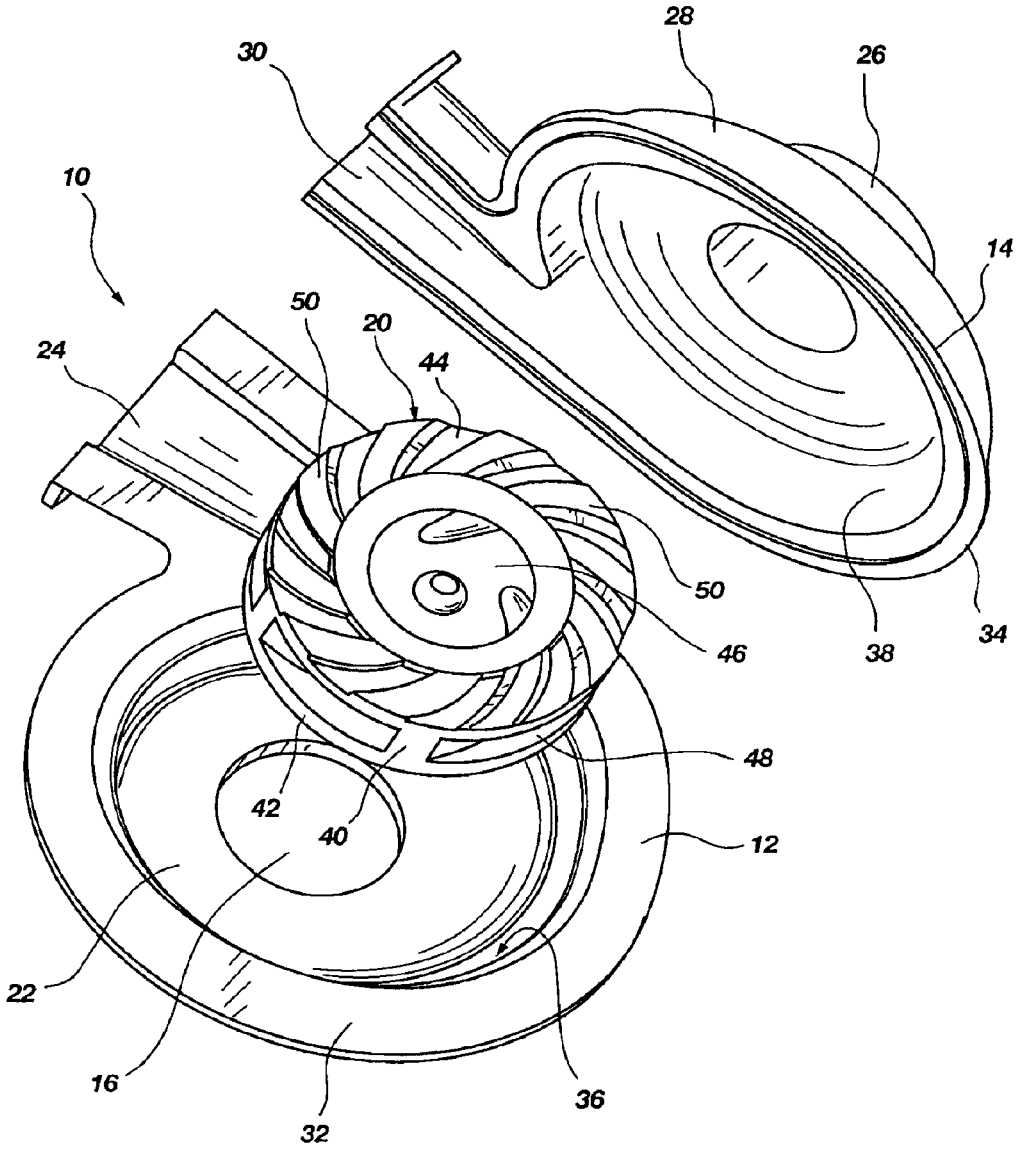
FIG. 1 is an exploded perspective view of a pump casing liner and impeller.

FIG. 1 illustrates that a centrifugal pump of the volute type may have a pump casing liner body 10 sized to be received in the pump casing. The pump casing liner body 10, like the pump casing, may be comprised of two clamshell-like halves 12, 14 that are sized to nest in the respective halves of a pump casing. It is preferred in most applications that a pump casing liner be used in the pump since a pump casing liner, once degraded by wear, can be removed and replaced with a new pump casing liner. The volute configuration of the present invention is, therefore, described and principally illustrated in terms of being incorporated into a pump casing liner of the type shown in FIG. 1. However, it is understood that the volute configuration of the present invention may be incorporated into the inner surface of the pump casing itself and is still within the purview of the invention.

Referring again to FIG. 1, one half of the pump casing liner body 10 may be referred to as the drive side liner 12 since the drive side liner 12 is formed with an opening 16 through which a portion of the impeller 20 extends to connect with the drive shaft (not shown) of a motor. The drive side liner 12 is generally comprised of a circular portion 22 and a tangentially extending discharge nozzle portion 24. The other half of the pump casing liner body 10 may be referred to as the suction side liner 14 since the suction side liner 14 is formed with an opening 26 which defines a fluid inlet through which slurry enters into the impeller 20. Likewise, the suction side liner 14 is generally comprised of a circular portion 28 and a tangentially extending discharge nozzle portion 30.

When the pump casing liner body 10 is positioned in the pump casing and the halves of the pump casing are aligned together, the respective peripheral edges 32, 34 of the drive side liner 12 and suction side liner 14 come into registration with each other and seal the impeller 20 within the pump casing. The drive side liner 12 of the pump casing liner body 10 has a wall portion 36 which extends substantially about the circumference of the circular portion 22, and the suction side liner 14 has a wall portion 38 which extends substantially about the circumference of the circular portion 28. The combination of the respective wall portions 36, 38, when the pump casing liner body 10 halves are brought together, defines the volute region of the pump, as described more fully below.

The impeller 20 that may typically be employed in a centrifugal pump having the volute configuration of the present invention is one formed with at least one impeller blade 40 that extends between a first shroud 42 oriented toward the drive side liner 12 and a second shroud 44 oriented toward the suction side liner 14. The impeller 20 is formed with a central opening 46 through which slurry enters into the impeller 20. The slurry contacts the impeller blades 40 and is directed out of the impeller 20 through at least one impeller opening 48 that is formed adjacent an impeller blade 40 and between the first shroud 42 and second shroud 44. The impeller 20 is further configured with at least one expelling vane 50 (a plurality being shown) which extends axially from the surface of the second shroud 44 in the direction of the suction side liner 14.

Figure 2:
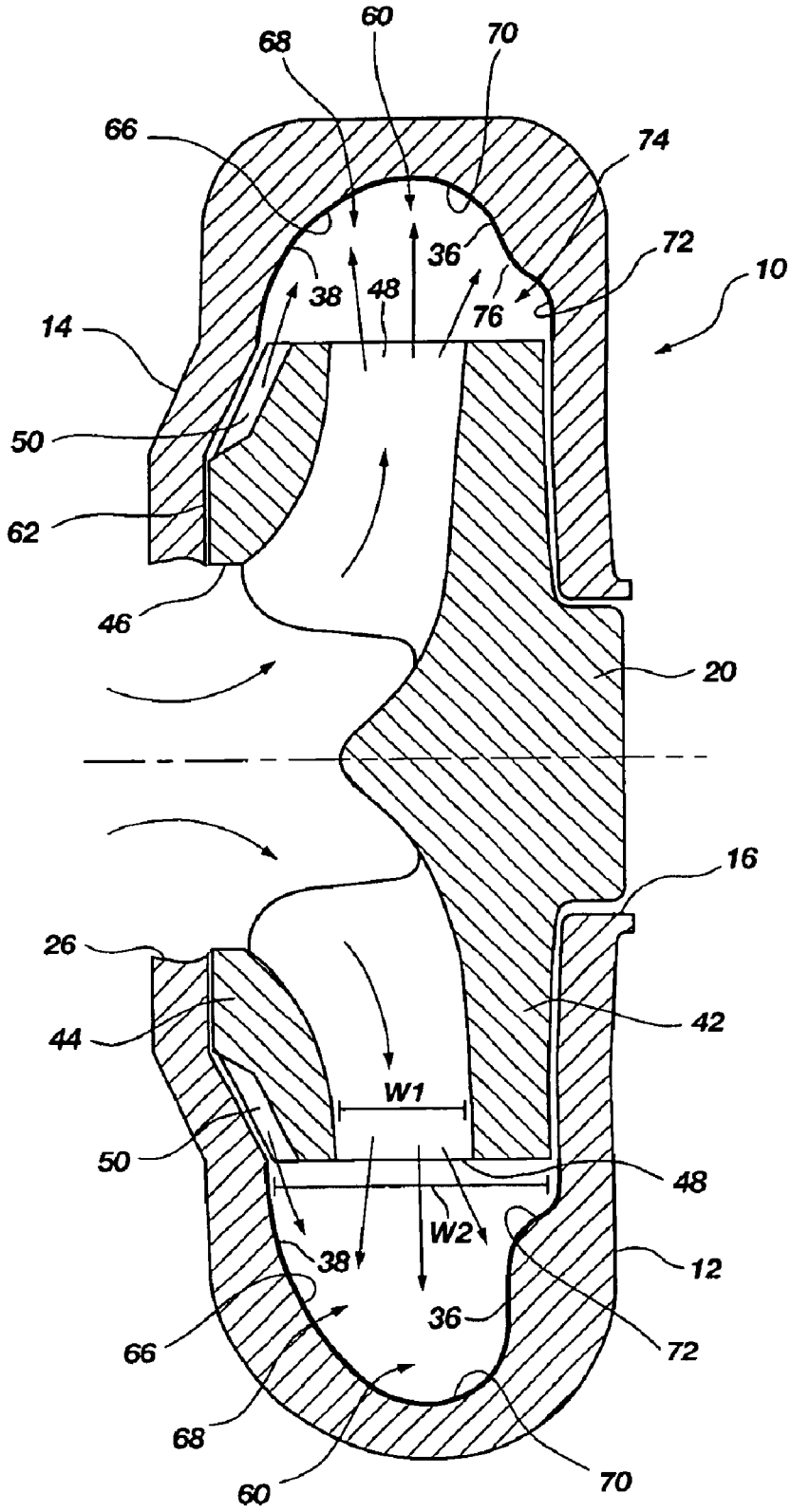
FIG. 2 is a view in axial cross section of the pump casing liner and impeller of the present invention taken at line 2—2 of FIG. 4.

The elements of the pump casing liner body 10 and impeller 20 are further illustrated in FIG. 2, which is an axial cross section view of a pump casing liner body 10 and impeller 20 as it would appear within a pump casing. The pump casing is not shown. FIG. 2 further illustrates by directional arrows how fluid enters into the impeller 20 through the opening 46 of the impeller 20 and is directed under centrifugal forces of the rotating impeller 20 to the volute 60 of the pump. The impeller 20 used in processing heavy duty slurries is structured with a relatively thick first shroud 42 and thick second shroud 44 to withstand the wear and degradation caused by the abrasiveness of the slurry. Consequently, the width W1 of the impeller opening 48 is more narrow than the general width W2 of the volute 60. As is known in the art, the disparity between the width W1 of the impeller opening 48 and width W2 of the volute 60 produces flow instabilities.

Additional effects on pump performance are brought about by the expelling vanes 50 that are incorporated in the impeller 20 used for processing heavy duty slurries. Expelling vanes 50 are beneficially used to direct abrasive slurry away from the seal face 62 between the second shroud 44 and the suction side liner 14. Slurry which infiltrates between the second shroud 44 and suction side liner 14 wears away at the seal face and degrades both the impeller 20 and liner 14, thereby adversely affecting pump performance. The aggressive expelling vanes 50 of the impeller 20 produce an extensive vortex behind each expelling vane 50 which pumps the slurry out and away from the seal face 62 and keeps the abrasive particles in suspension in the volute 60. However, the vortices produced by the expelling vanes 50 transfer added velocity to the solids particles which causes degradation of the pump casing or pump liner in prior art volute configurations.

Figure 3:
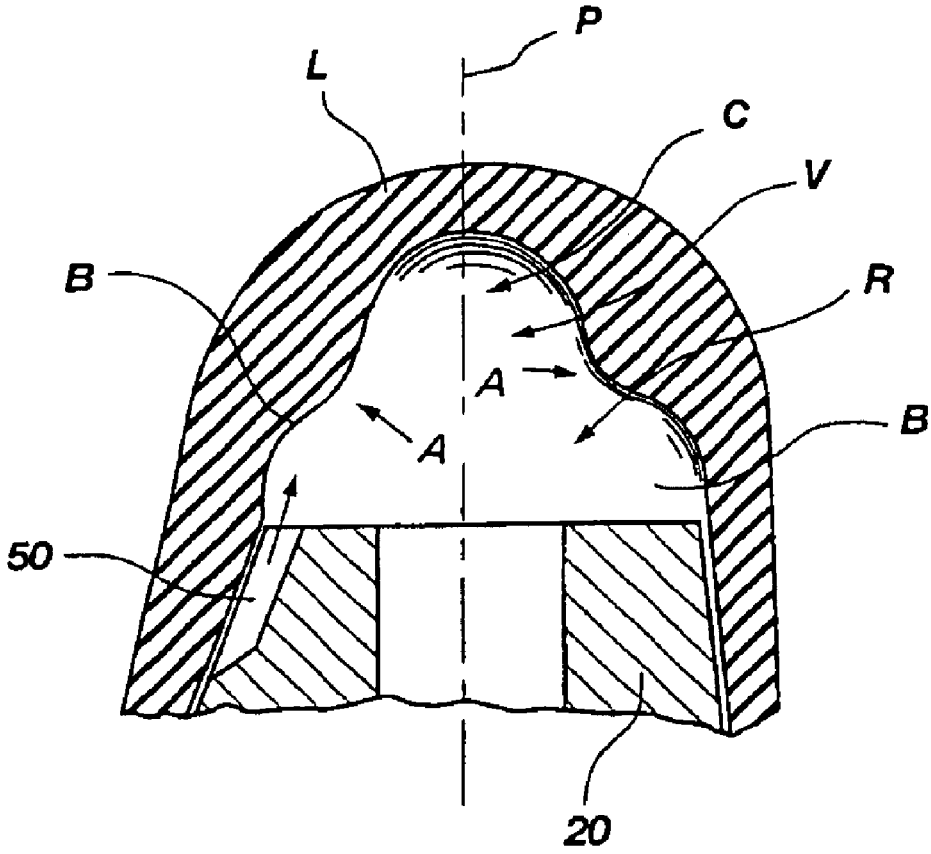
FIG. 3 (PRIOR ART)
FIG. 3 is a view in axial cross section of a portion of a pump casing liner and impeller of the prior art.

FIG. 3 illustrates more clearly how the use of an impeller 20 having aggressive expelling vanes 50 causes degradation in a prior art pump casing liner L. The pump casing liner L described in the prior art has a volute V which comprises a collection zone C and a recirculation zone R. The recirculation zone R further comprises two spaced apart buffer zones B, each of which is defined by a concave region. The collection zone C further comprises a concave portion that is separated from the concave regions of the buffer zones B by a convex structure A that extends inwardly toward the impeller 20. It can be seen from FIG. 3 that the configuration of the prior art volute V is substantially symmetrical about a plane P which radially bisects the pump liner L and volute V. The vortices that are produced by the aggressive expelling vanes 50 produce an increased velocity in the particulates of the slurry which strike the convex structure A of the prior art pump liner L and degrade it. Consequently, rapid material erosion results, pump performance suffers and premature failure in service may occur.

Accordingly, the volute 60 of the present invention, illustrated in FIGS. 2–6, is configured to withstand the increased velocities of the slurry particulates and to attain stable flow performance in the pump. Referring again to FIG. 2, the volute 60 of the present invention is formed from a first wall portion 36 associated with the drive side liner 12 and a second wall portion 38 associated with the suction side liner 14. The second wall portion 38 is configured with a curved surface 66 which defines at least a portion of a collection region 68 of the volute 60. The collection region 68 receives fluid being expelled from the impeller opening 48 and from the expelling vanes 50. The curved surface 66 of the collection region 68 has a radius of curvature which is selected to stabilize fluid flow in the collection region 68.

The volute 60 of the present invention is further formed from a first wall portion 36 associated with the drive side liner 12 of the pump casing liner body 10. The first wall portion 36, along a significant extent of the circumference of the pump casing liner body 10, is configured with a first concave region 70 which is continuous with the curved surface 66 of the second wall portion 38 to complete the collection region 68 of the volute 60. The first wall portion 36, along a significant extent of the circumference of the pump casing liner body 10, is further configured with a second concave region 72 which defines a circulation zone 74. The first concave region 70 and second concave region 72 are separated by a convex structure 76 therebetween which extends toward the impeller 20. The circulation zone 74 operates to receive fluid flowing from the impeller opening 48 and redirect it at a modified flow velocity into the collection zone 68, thereby reducing flow turbulence.

Figure 4:
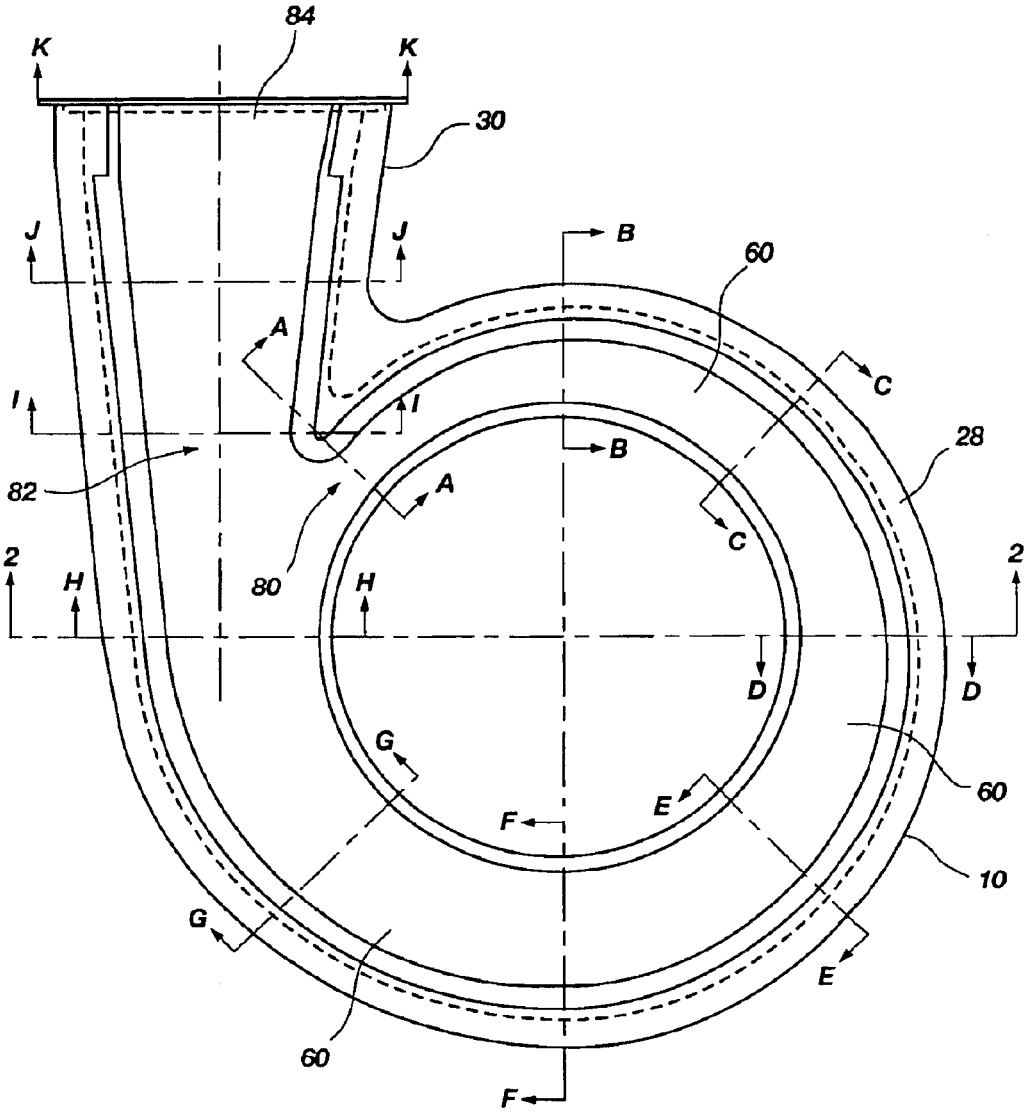
FIG. 4 is a view in elevation of the inner side of the suction side pump casing liner shown in FIG. 1.

It can be appreciated from the illustration of FIG. 2 that the configuration of the volute 60, as viewed in axial cross section, changes as the volute 60 continuously extends about the circumference of the pump casing liner body 10. The configuration of the volute 60 gradually and continuously changes as the volute 60 extends about the circumference of the pump casing liner body 10 to optimize the hydraulic interaction between the impeller and the volute 60 and to provide stable flow performance and efficient pump performance. FIG. 4 illustrates more clearly that the pump casing liner body 10 comprises a circular portion 28 and a discharge nozzle 30 portion which extends tangentially from the circular portion 28. The volute 60 of the pump casing liner body 10 extends continuously along the circumference of the pump casing liner body 10 from a region known as the cutwater 80 to a throat region 82. The throat region 82 continues into the discharge nozzle 30 portion of the pump casing liner body 10 to a terminal end 84 of the discharge nozzle portion 30. Sections designated A—A through K—K of the pump casing liner body 10 are shown in FIG. 4 and correspond to the partial axial cross section views of the volute 60 shown in FIGS. 5A through 5K.

Figure 5A:
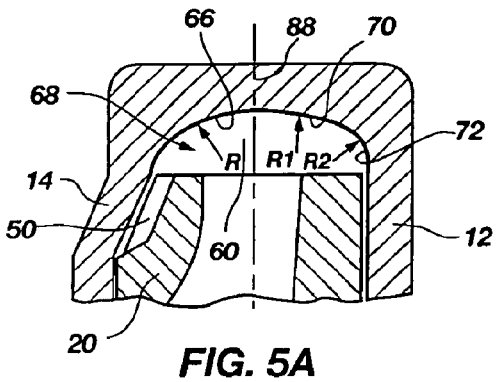
FIGS. 5A–5K are views in partial axial cross section of a pump casing liner and impeller of the present invention, as shown in FIG. 1, the figures being taken at lines A—A through K—K of FIG. 4.

FIG. 5A is a partial axial cross section of the pump casing liner body 10, impeller and volute 60 at the cutwater 80

(FIG. 4) of the pump. It can be seen that the curved surface 66 of the suction side liner 14 has a selected radius of curvature R which is comparatively small in this section of the pump. It can also be seen that in this section of the pump, the first concave section 70 is continuous with the second concave section 72, but the radius of curvature R1 of the first concave section 70 is distinct from the radius of curvature R2 of the second concave section. It is also notable that the configuration of the volute 60 at the cutwater is asymmetrical about a plane 88 which radially bisects the pump casing liner body 10 and volute 60. The plane 88 may be generally defined by the point of joinder of the suction side liner 14 to the drive side liner 12.

Figure 5B:
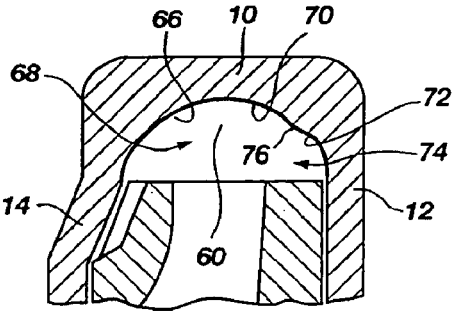
Figure 5C:
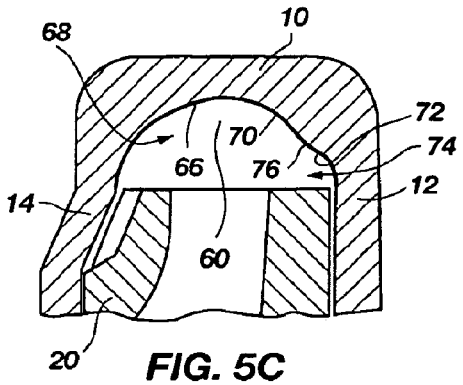
Figure 5D:
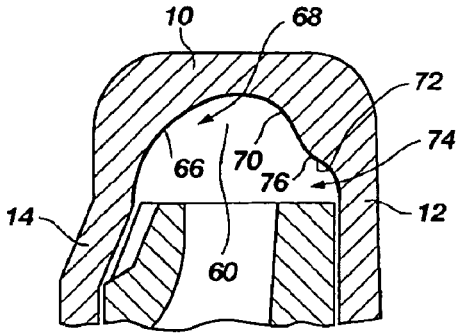
Figure 5E:
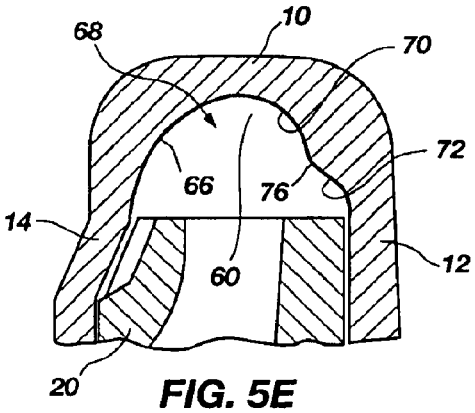
Figure 5F:
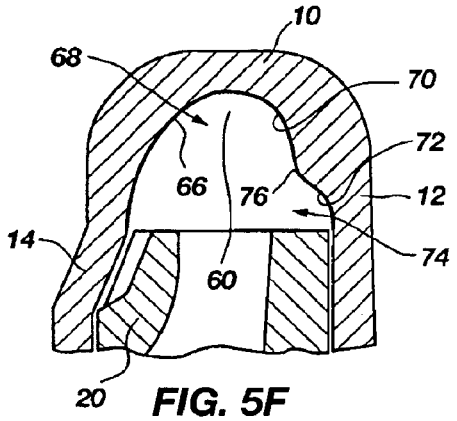
Figure 5G:
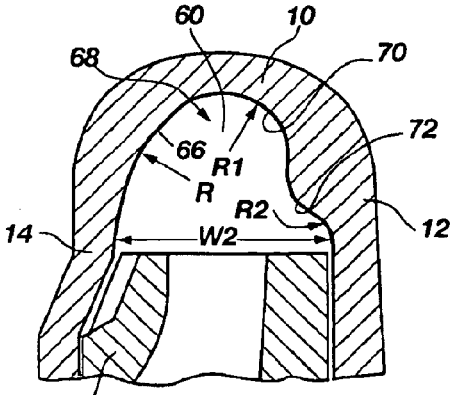

As the volute 60 continues smoothly about the circumference of the pump, as shown in FIGS. 5B and 5C, the configuration of the volute 60 transitions to a curved surface 66 the radius of curvature R of which is increasing, Also the radius of curvature R1 of the first concave region 70 continues to increase, as does the radius of curvature R2 of the second concave region 72 to form a circulation zone 74. The convex structure 76 which separates the first concave region 70 from the second concave region 72 becomes more pronounced and extends toward the impeller 20.

Figure 5H:
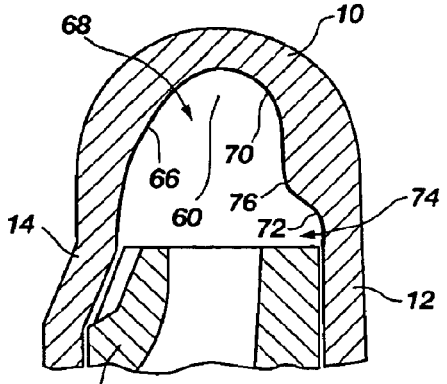

FIGS. 5D through 5H illustrate that as the volute 60 extends further along the circumference of the pump, the collection zone 68 becomes more elongated in a radial direction from the impeller 20 to produce a collection zone 68 of greater volume as compared with the collection zone 68 near the cutwater (FIG. 5A). The radius of curvature R of the curved surface 66 continues to change, as do the radii of curvature R1 and R2, respectively, of the first concave region 70 and the second concave region 72. As the volute 60 nears the throat region 82 (FIG. 4) of the pump, as shown in FIG. 5H, the circulation zone 74 begins to compress in radial length as the radial length at the collection zone 68 has increased.

Figure 5I:
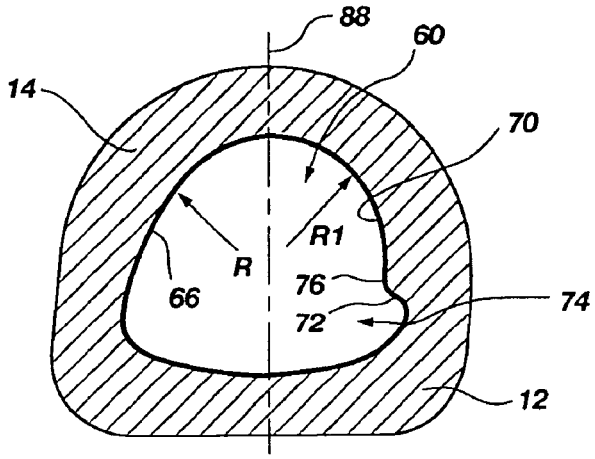
Figure 5J:
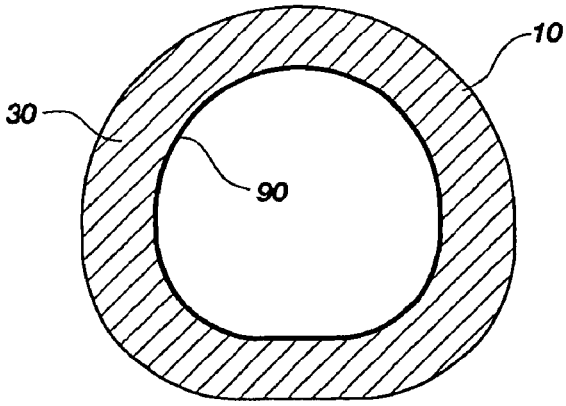
Figure 5K:
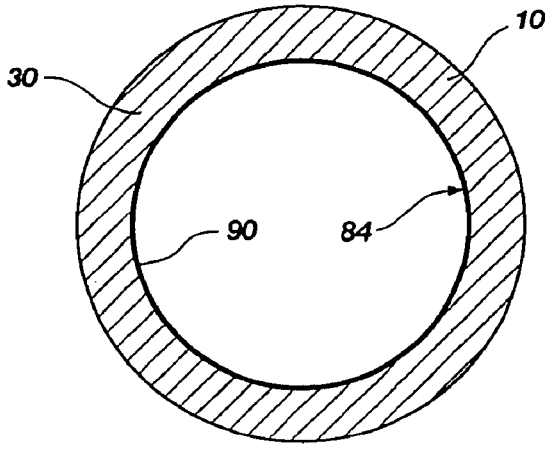

As the volute 60 transitions into the throat region 82 of the pump, as shown in FIG. 5I, the configuration of the volute 60 remains asymmetrical about radial plane 88. The circulation zone 74 is reduced in size and the radius of curvature R1 of the first concave region 70 begins to approach the radius of curvature R of the curved surface 66. At a midpoint between the throat region 82 and terminal end 84 of the discharge nozzle portion 30, as illustrated in FIG. 5J, the volute 60 smoothly transitions into the inner surface 90 of the discharge nozzle portion 30. At this point, the configuration of the inner surface 90 of the pump casing liner body 10, in axial cross section, is becoming generally circular until, at the terminal end 84 of the discharge nozzle portion 30 shown in FIG. 5K, the inner surface 90 is substantially circular.

Figure 6:
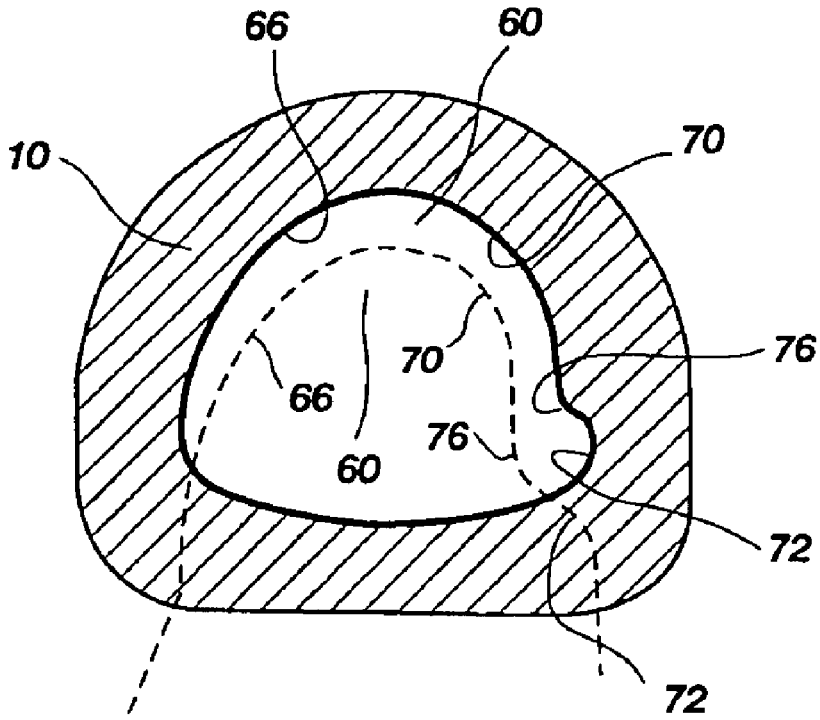
FIG. 6 is a partial view in axial cross section of the pump casing liner and impeller of the present invention taken at line I—I of FIG. 4, with the contour of the section of the volute taken at line H—H superimposed in phantom thereover.

FIG. 6 illustrates more clearly the smooth change in the configuration of the volute 60 as the volute 60 approaches the throat region 82 of the pump. Shown in axial cross section is the configuration of the volute 60 at line I—I of FIG. 4 with an outline of the configuration of the volute 60 configuration at line H—H superimposed in phantom thereover. It can be seen that as the volute 60 extends circumferentially toward the discharge nozzle portion 30, the convex structure 76 gradually recedes in prominence until the convex structure 76 disappears at the discharge nozzle portion 30 (FIG. 5J).

The configured volute of the present invention is selected to provide efficient pump performance and stable flow performance in centrifugal pumps of the volute type When used to process slurries containing particularly coarse and/or abrasive particulates. The configured volute of the present invention is described herein principally with respect to its incorporation into the pump casing liner of a pump. However, the configured volute as described herein may also be incorporated directly into a cast or machined pump casing which does not employ a liner. Further, the exact dimensions of the elements of the volute configuration as described herein may vary as dictated by a particular application or type of slurry being processed. Therefore, reference herein to specific details of the volute configurations are by way of example only and not by way of limitation.

What is claimed is:

1. A centrifugal pump of the volute type comprising a pump casing with a suction side and a drive side, a circular portion extending between a cutwater region and a throat region, a discharge nozzle extending tangentially from the circular portion, and an impeller positioned within the pump casing and a drive shaft axially connected to the impeller for rotating the impeller within the pump casing about an axis, the pump casing having a contoured volute region formed along the outer periphery of the circular portion of the pump casing extending from the cutwater region to the throat region of the pump casing, the contour of the volute region, in axial cross section, being such that in a section of the circular portion extending from beyond said cutwater to said throat region the drive side of the casing is formed with two radii of curvature separated by a convex portion, the suction side of the casing is formed with a single radius of curvature and said outer periphery of said pump casing extending between said drive side and said suction side is curved relative to said axis and the curvature of said curved outer periphery changes about the arc of the circular portion extending from said cutwater region to said throat region.

2. The centrifugal pump of claim 1 wherein said drive side of said contoured volute region further comprises a first wall portion having a first concave region having a selected first radius of curvature that changes about the arc of said circular portion and a second concave region having a selected second radius of curvature, and wherein said suction side of said contoured volute region further comprises a second wall portion having a curved surface which, in combination with said first concave region, defines a collection zone for receiving fluid.

3. The centrifugal pump of claim 2 wherein said second concave region defines a circulation zone for directing fluid from said impeller to said collection zone.

4. The centrifugal pump of claim 3 wherein said impeller is further configured with at least one aggressive expelling vane positioned proximate said curved surface of said second wall portion.

5. The centrifugal pump of claim 4 wherein said contoured volute region is formed in the interior peripheral surface of a pump casing liner which is sized to be received in said pump casing.

6. The centrifugal pump of claim 4 wherein said radius of curvature of said collection zone increases as said contoured volute region extends continuously from said cutwater region of said pump to said throat region of said pump.

7. The centrifugal pump of claim 1 wherein said contoured volute region is formed in the interior peripheral surface of a pump casing liner sized to be received in said pump casing.

8. A removable liner for a centrifugal slurry pump having a pump casing defining a volute region and discharge nozzle, comprising:

a pump casing liner body sized to be received in the pump casing of a centrifugal slurry pump having a circular portion and a discharge nozzle extending tangentially from the circular portion, said pump casing liner body having a cutwater region, a throat region and a tangentially-directed discharge nozzle portion, a drive side and a suction side, and further having an inner peripheral surface extending from said cutwater region to said discharge nozzle portion; and a contoured volute located along said inner peripheral surface of said pump casing liner body extending continuously from said cutwater region to said throat region of said pump casing liner body, said contoured volute comprising a drive side being configured, in axial cross section, with at least one concave portion positioned adjacent a convex portion, a suction side configured, in axial cross section, with a curved surface devoid of any convexity and an arcuate surface extending between said drive side and said suction side of said contoured volute co-extensive with said peripheral surface of said pump casing, the curvature of said arcuate surface changing along an arc of said contoured volute from said cutwater to said throat region.

9. The removable liner of claim 8 wherein said configured volute further comprises a collection zone and a circulation zone positioned to direct fluid into said collection zone, said circulation zone comprising a concave region having a smaller radius of curvature than the radius of curvature of said collection zone.

10. The removable liner of claim 9 wherein said radius of curvature of said collection zone increases from said cutwater region to said throat region of said configured volute as said contoured volute extends continuously therebetween.

11. The removable liner of claim 8 wherein said pump casing liner body further comprises a drive side liner having a peripheral edge and a suction side liner having a peripheral edge which is positioned in registration with said peripheral edge of said drive side liner to provide an enclosure for an impeller, said drive side liner and said suction side liner each having a wall portion the combination of which defines said contoured volute.

12. The removable liner of claim 11 wherein said wall portion of said suction side liner has a curved surface which defines a portion of a collection zone and wherein said wall portion of said drive side liner further comprises a first concave region which is continuous with said curved surface to define said collection zone and a second concave region which defines a circulation zone.

13. The removable liner of claim 12 wherein said curved surface of said suction side has a radius of curvature which increases as said contoured volute extends continuously from said cutwater region to said throat region.

14. The removable liner of claim 12 wherein said first concave region has a radius of curvature and said second concave region has a radius of curvature, said radius of curvature of said first concave region increasing relative to said radius of curvature of said second concave region as said contoured volute extends continuously from said cutwater region to said throat region.

15. The removable liner of claim 12 wherein said curved surface of said suction side liner is located for positioning proximate to an expelling vane of an impeller to receive slurry from the expelling vane.

16. The removable liner of claim 12 wherein said first concave region is separated from said second concave region by a convex structure which extends outward from said wall portion of said drive side liner.

17. The removable liner of claim 16 wherein said convex structure gradually recedes in prominence as said contoured volute extends continuously toward said throat region.

18. A centrifugal pump of the volute type comprising a pump casing with a suction side and a drive side and having a contoured volute region formed along an outer periphery of an outer circular portion of the pump casing extending from the cutwater region to the throat region of the pump casing, the contour of the volute region, in axial cross section, being such that in any section of the circular portion extending from past the cutwater to the throat region the drive side of the casing is formed with at least one concavity positioned adjacent a convex portion, said suction side of the casing is formed with a curved surface devoid of any convexity, and an arcuate surface extends between said curved surface of said suction side and said drive side along said outer periphery of said outer circular portion, the curvature of said arcuate surface changing through the arc of said circular portion from said cutwater region to said throat region.

19. The centrifugal pump of claim 18 wherein said contoured volute is formed as a removable pump casing liner.

* * * * *